United States Patent [19]

Vanek

[11] Patent Number: 4,898,519

[45] Date of Patent: Feb. 6, 1990

[54] DEEP WELL SOLAR PUMP

[76] Inventor: Jaroslav Vanek, 414 Triphammer Rd., Ithaca, N.Y. 14850

[21] Appl. No.: 354,465

[22] Filed: May 18, 1989

[51] Int. Cl.[4] ..... F04B 17/00; F04B 47/08

[52] U.S. Cl. ..... 417/379; 60/478

[58] Field of Search ..... 417/379, 478; 60/641.8

[56] References Cited

U.S. PATENT DOCUMENTS

| | | | |
|---|---|---|---|
| 116,025 | 6/1871 | Clow et al. | 417/379 |
| 4,701,107 | 10/1987 | Dickinson et al. | 417/478 |

FOREIGN PATENT DOCUMENTS

| | | | |
|---|---|---|---|
| 2854947 | 12/1978 | Fed. Rep. of Germany | 417/379 |
| 3542865 | 7/1986 | Fed. Rep. of Germany | 417/379 |
| 855 | 2/1985 | World Int. Prop. O. | 60/641.8 |

*Primary Examiner*—Leonard E. Smith
*Assistant Examiner*—David L. Cavanaugh
*Attorney, Agent, or Firm*—Peter L. Tailer

[57] ABSTRACT

A solar deep well steam pump has a solar collector, a steam boiler in the collector's focus, a deep well bladder pump having an actuating tube and a water delivery tube, and a mechanism periodically injecting steam under pressure from the boiler into the actuating tube of the bladder pump, the mechanism having an expansion chamber connected to the actuating tube of the bladder pump, a long period pendulum swinging by gravity to a first position, a steam injection valve between the boiler and the expansion chamber, the steam injection valve being opened by the pendulum in the first position, an impulse bladder connected to the expansion chamber so that steam pressure in the expansion chamber inflates the impulse bladder against the pendulum in the first position to urge the pendulum against the force of gravity toward a second position, an exhaust valve leading from the expansion chamber to the atmosphere, the exhaust valve being opened by the pendulum in the second position, the injection of steam into the expansion chamber by the injection valve forcing water down the actuating tube of the bladder pump and forcing pumped water from the delivery tube, the release of pressure in the expansion chamber by the exhasut valve allowing water to be forced back up the actuating tube into the expansion chamber for a subsequent pump cycle. A multi-layer pump bladder is adjustable according to well depth. The pump can also be operated by any source of compressed air or gas.

9 Claims, 2 Drawing Sheets

DEEP WELL SOLAR PUMP

FIELD OF THE INVENTION

This invention provides a pump that can use solar generated steam or any gas under pressure to raise water from a deep well.

DESCRIPTION OF THE PRIOR ART

Bladder pumps are known. A deep well pump, known as the Vergnet pump, has a single layer elastic bladder in a pump cylinder. The pump cylinder has an inlet check valve, an outlet check valve, an actuating tube extending down the well to the pump bladder, and a water delivery tube extending up the well from the outlet check valve. In the Vergnet pump water is forced down the actuating tube by a plunger operated by stepping on a foot pedal. This expands the bladder forcing water up the delivery tube. On releasing the pedal, the bladder contracts drawing water into the pump cylinder through the inlet check valve and forcing water back up the actuating tube for a subsequent pump cycle.

SUMMARY OF THE INVENTION

It is an object of this invention to provide a deep well pump operated by solar generated steam for use in non-industrialized countries that lack fuels.

Another object of this invention is to provide a solar deep well pump that may be very easily manufactured for a low capital cost using readily available materials.

A further object of this invention is to provide a pump of maximum efficiency operated by solar generated steam or any other source of gas under pressure.

DESCRIPTION OF THE PREFERRED EMBODIMENT

Figures 1, 2, 3:
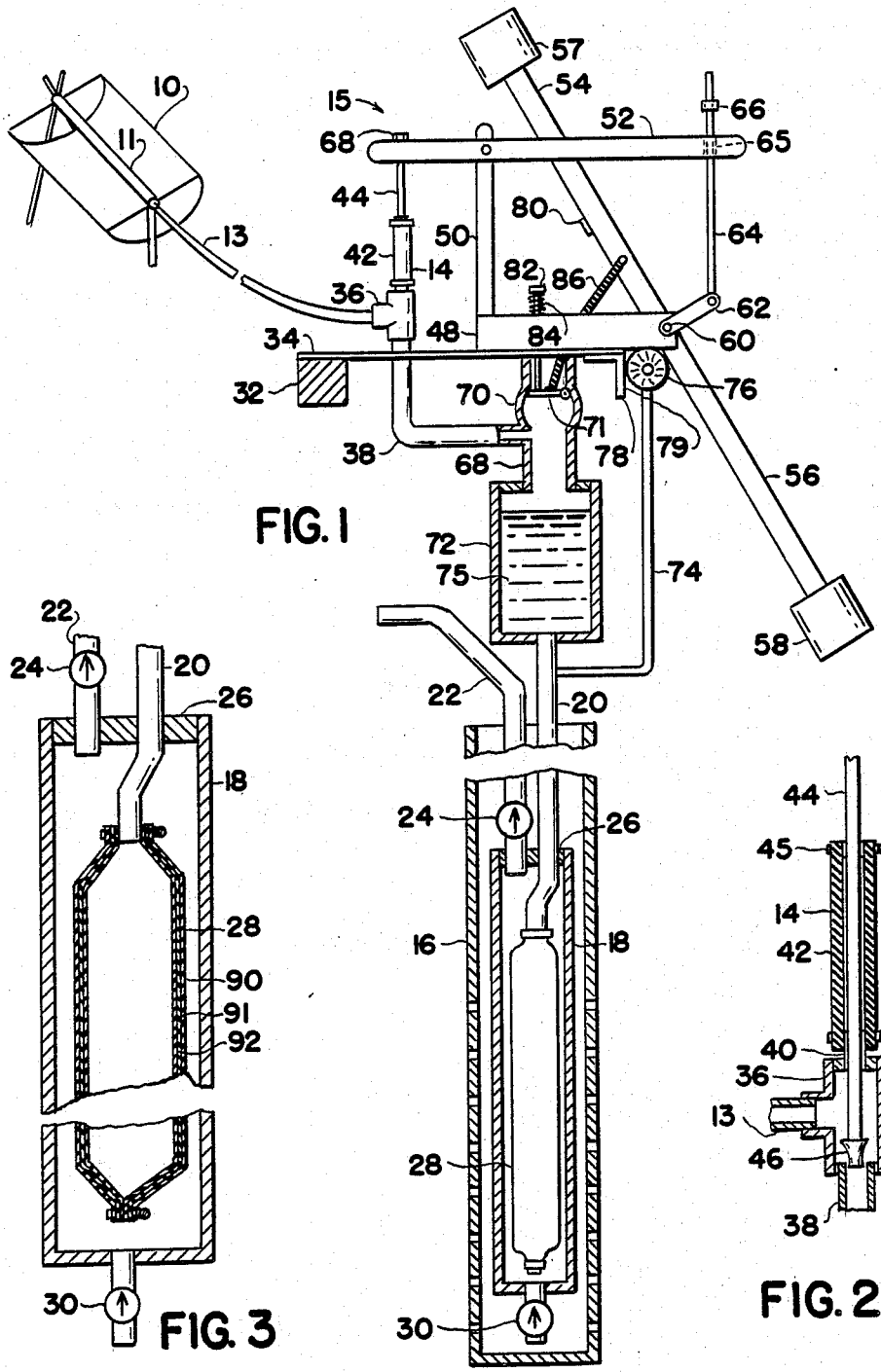
FIG. 1 is a side view of the deep well solar pump of this invention with portions shown in section and with a connected steam generating solar collector shown in perspective.
FIG. 2 is a vertical section through a steam injection valve.
FIG. 3 is a longitudinal section through a bladder pump cylinder having a bladder modified according to this invention.

Referring to the drawings in detail, FIG. 1 shows the deep well pump of this invention. A single axis tracking collector 10 has a tubular steam boiler 11 in its focus. An insulated steam line 13 leads to steam injection valve 14 of the mechanism generally designated by the reference numeral 15.

A well casing 16 contains a pump cylinder 18 which is also shown in FIG. 3. An actuating tube 20 and a water delivery tube 22 extend down the well casing 16. Water delivery tube 22 is connected to an outlet check valve 24 mounted on and allowing flow upward past a top closure 26. Actuating tube 20 extends through top closure 26 to enter an elastic bladder 28. An inlet check valve 30 at the bottom of cylinder 18 allows well water flow into cylinder 18.

Mounted on a suitable frame member 32 is a base plate 34 through which steam injection valve 14 is mounted. As shown in FIG. 2, steam injection valve 14 receives steam through line 13 in the leg of "T" 36. Steam delivery line 38 is fixed to base plate 34 and mounts "T" 36. A small tubular extension 40 extends upward from "T" 36 to have a soft rubber sleeve 42 clamped about it by clamp 43. A valve shaft 44 extends slidably through extension 40 and through sleeve 42. Sleeve 42 has its lower end clamped about extension 40 by clamp 43. The upper end of the rubber sleeve 42 is clamped gas tight around valve shaft 44 by clamp 45.

A tapered plug 46 at the lower end of shaft 44 seals the upper end of tube 38. The plug 46 can be the readily available center cone bearing of a bicycle wheel.

As shown in FIG. 1, a mounting bracket 48 is fixed on base plate 34. An upstanding support 50 has a control lever 52 pivotally mounted at its upper end. A long period pendulum 54 has a shaft 56 centrally fixed to and rotatably mounted by axle 60. Shaft 56 has weight 57 and 58 at its ends. Weight 58 is either heavier or further from axle 60 than weight 57. This tends to turn pendulum 54 clockwise as shown so weight 58 is in a lowermost first position. A pendulum arm 62 is fixed to axle 60 at right angles to shaft 56. A wire link 64 extends upward from arm 62 through a clearance aperture 65 in lever 52. An adjustable nut 66 is disposed on link 64 so that, when pendulum 54 is substantially vertical in the first position, nut 66 will pull down the end of control lever 52. Link 64 may be a bicycle wheel spoke.

Valve shaft 44 also has an adjustable nut 66 at its upper end. When the pendulum 54 swings clockwise to a second position to rotate control lever 52 clockwise by means of link 64, valve shaft 44 is pulled upward stretching rubber sleeve 42 and opening steam injection valve 14. Steam then flows through line 38 into a tube or pipe nipple 68 which has an exhaust valve 70 at its upper end with a swinging closure 71. Exhaust valve 70 may be a conventional swing check valve. Below tube 68 is an expansion chamber 72 connected to the upper end of actuating tube 20. An impulse tube 74 leads from below expansion tank 72 to an impulse bladder 76. Bladder 76 may be a short length of bicycle inner tube sealed about the end of tube 74 and closed at the other end of the short length.

A length of angle iron 78 is fixed to base 34. Angle iron 78 has a surface 79 adjacent to impulse bladder 76 so that bladder 76 is between shaft 56 and surface 79 at the first position of the swing of pendulum 54. In this position of pendulum 54, steam injection valve 14 is opened so that the steam pressure acting through water in expansion chamber 72 inflates impulse bladder 76 to push against and give an impulse to pendulum 54 to maintain its oscillating motion.

Expansion chamber 72 is filled with water 75 as is actuating tube 20 and pump bladder 28. Steam under pressure introduced in expansion chamber 72 forces water down tube 20 to inflate bladder 28 and force water to the top of the well casing 16 through delivery tube 22. Nut 66 is adjusted so that steam injection valve 14 closes after a short interval to allow steam in chamber 72 to continue to expand while pendulum 54 rotates counter-clockwise as it is shown in FIG. 1.

When pendulum 54 is substantially horizontal in a second position, a striker 80 on arm 56 forces plunger 82 down against the slight upward force of compression spring 84. Plunger 82 opens the swinging closure 71 of exhaust valve 70 against gas pressure to open expansion chamber 72 to the atmosphere. The opening of exhaust valve 70 allows pump bladder 28 to contract and force water back up tube 20 into chamber 72. As the elastic pump bladder 28 contracts, more water to be pumped is drawn into cylinder 18 through check valve 30. As pendulum 54 swings clockwise from the horizontal position, an elastic strand 86 fixed between arm 56 and the swinging closure 71 closes exhaust valve 70 so that later injected steam will be contained within expansion chamber 72. The elastic strand 86 only need close the swinging closure 71 and exerts so small a force that it does not restrict motion of the pendulum 54. Strand 86 is of a length to allow exhaust valve 70 to remain open for a needed period of time so that contraction of pump bladder 28 can accelerate water up actuating tube 20 into chamber 72.

To increase the efficiency of the steam injection pump, the pump bladder 28 is made from several layers 90, 91, and 92 of tubular elastic material such as the elastomer butyl. According to the vertical distance the expansion chamber 72 is above bladder 28, additional layers 90 may be added so that the head of water pressure is about balanced by the contraction of the bladder 28. This allows a minimum steam pressure only slightly greater than the head of water above bladder 28 to expand bladder 28 and force water up delivery tube 22. If water is being pumped up 68 feet, a minimum steam pressure of 30 psig is required. If steam is injected at a higher pressure, the steam may be made efficiently used as it can be allowed to expand to 30 psig after closure of the injection valve 14 and before the pendulum 54 opens exhaust valve 70.

As in all bladder pumps, there may be some slight loss of water through leakage from the actuating tube 20 or the bladder 28. In the pump of this invention, any loss is made up by the condensation of steam in the expansion chamber 72. When pumping at moderate depths, condensation will take place in expansion chamber 72 as it is cooled by air. If too much condensate water 75 starts to overfill chamber 72, its level is automatically regulated as too high a water 75 level will allow some water 75 to be blown out exhaust valve 70 on its opening.

Figure 4:
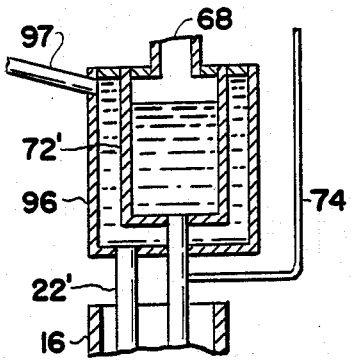
FIG. 4 is a vertical section through a broken away fragment of the pump showing a modified expansion chamber; and, FIG. 5 is a vertical section through a broken away fragmant of the pump showing a modification providing pressurized water.

When pumping at depths that require higher pressure and temperature steam, expansion chamber 72 may become heated so steam will not condense in it. As shown in FIG. 4, expansion chamber 72' is surrounded by a water jacket 96 which is entered by delivery tube 22'. Water jacket 96 has an outflow spout 97. Water jacket 96 allows pumped water to cool expansion chamber 72' and ensure condensation in it.

Figure 5:
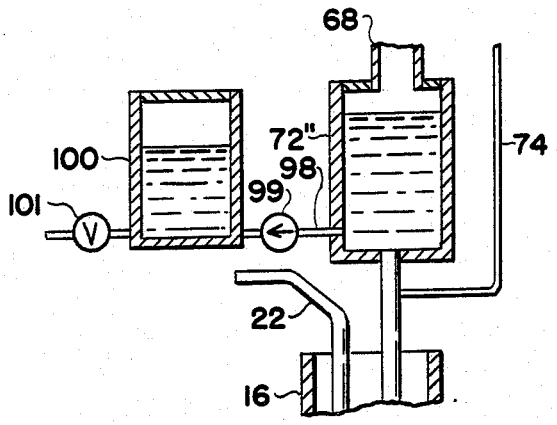

As shown in FIG. 5, a pressurized water tube 98 leads from expansion chamber 72'' through a check valve 99 into a pressure tank 100. Tank 100 provides a limited source of water under pressure when valve 101 is opened to operate a solar tracking device (not shown) for solar collector 10 or for other purposes. The amount of pressurized water is limited as it is derived from condensation.

The most available and least costly material for the tubes 20 and 22 is polyethylene tubing. So that this tubing won't be softened by heat from steam, the first upper few feet of tube 20 may be of copper tubing or steel pipe. While this pump has been described as a deep well pump, it can also pump from shallow wells, lakes, or rivers. The tolerances required for its manufacture are very wide so that it can be built in non-industrialized countries using hand tools. If a source of gas under pressure is available, it can be used in place of steam to operate the pump. The injection mechanism with its pendulum can be set to provide as long or as short a period as required. Moving the weights 57 and 58 inward toward axle 60 speeds up the period of oscillation. The injection mechanism can also be used to directly inject steam or any gas under pressure into a direct injection pumping device.

What is claimed is:

1. In a pump having a source of gas under pressure, and a gas operated pump, a mechanism periodically injecting gas from said source of gas into said gas operated pump, said mechanism comprising, in combination, a long period pendulum turning towards a first position by gravity, an injection valve connected between said source of gas under pressure and said gas operated pump, a linkage between said pendulum and said injection valve, said linkage opening said injection valve when said pendulum is in said first position, an impulse tube connected between said injection valve and said gas operated pump, a member having a surface adjacent to the first position of said pendulum, and an elastic impulse bladder connected to said impulse tube adjacent to said surface so that inflation of said impulse bladder on the opening of said injection valve forces said impulse bladder against said pendulum urging said pendulum against the force of gravity toward a second position.

2. The combination according to claim 1 wherein said gas pressure operated pump is a bladder pump having a pump cylinder, an inlet check valve in said pump cylinder, an actuating tube extending into said pump cylinder, an elastic bladder in said pump cylinder connected to said actuating tube, an outlet check valve leading from said pump cylinder, and a water delivery tube extending from said outlet check valve, said mechanism injecting gas under pressure injecting gas into said actuating tube, and with the addition of an expansion chamber between said injection valve and said actuating tube, an exhaust valve to the atmosphere connected to said expansion chamber, and means activated by said pendulum in said second position opening said exhaust valve.

3. The combination according to claim 2 wherein said source of gas under pressure is a solar collector having a focus, and a steam boiler in the focus of said collector, said exhaust valve having a swinging closure, and with the addition of a striker on said pendulum, a plunger above said exhaust valve, said striker contacting said plunger when said pendulum is in said second position forcing said plunger down against said swinging closure of said exhaust valve opening said exhaust valve, and means closing said swinging closure on subsequent movement of said pendulum towards said first position.

4. The combination according to claim 3 wherein said means closing said swinging closure is an elastic strand connected between said swinging closure and said pendulum.

5. The combination according to claim 4 with the addition of a rotatable axle mounting said pendulum, a pendulum arm on said rotatable axle, a pivotally mounted control arm having a first end above said pendulum arm and a second end bove said injection valve, said control arm end above said pendulum arm containing an aperture, a link from said pendulum arm extending slidably through said aperture in said control arm, and an adjustable nut on said link so that said nut pivots said control arm when said pendulum is in said first position, and means at said second end of said control arm opening said injection valve.

6. The combination according to claim 5 wherein said injection valve has a "T" with upper and lower ends and a leg, said steam boiler being connected to said leg, said expansion chamber being connected to said lower end of said "T", a valve shaft extending down through the upper end of said "T", a plug at the lower end of said valve shaft closing said lower end of said "T", and a soft rubber tube disposed about said valve shaft fixed at the upper end of said "T" and to said valve shaft, said valve shaft being connected to said second end of said control arm so that pivoting of said control arm lifts said valve shaft stretching said rubber tube and raising said plug to open said injection valve.

7. The combination according to claim 6 wherein said elastic pump bladder has multiple layers, the number of said layers substantially balancing the head of water above the pump bladder.

8. The combination according to claim 7 with the addition of a water jacket disposed about said expansion chamber, said water delivery tube conducting pumped water into said water jacket, and an outflow spout conducting pumped water from said water jacket.

9. The combination according to claim 7 with the addition of a pressure vessel, a pressurized water tube connecting said expansion chamber and said pressurized vessel, and a check valve in said pressurized water tube allowing flow from said expansion chamber into said pressurized vessel.

* * * * *